United States Patent [19]

Anderheggen et al.

[11] Patent Number: 5,024,797

[45] Date of Patent: Jun. 18, 1991

[54] PROCESSES FOR THE PRODUCTION OF MONO- AND MULTIFILAMENTS AND STAPLE FIBERS BASED ON POLYARYLENE SULFIDES

[75] Inventors: Wolfgang Anderheggen; Michael Kraemer, both of Dormagen; Roland Vogelsgesang, Leverkusen; Wolfram Wagner, Dormagen; Wolfgang Olges, Hilden; Thomas Dragovic, Pulheim, all of Fed. Rep. of Germany

[73] Assignee: Bayer Aktiengesellschaft, Leverkusen, Fed. Rep. of Germany

[21] Appl. No.: 522,296

[22] Filed: May 11, 1990

[30] Foreign Application Priority Data

May 17, 1989 [DE] Fed. Rep. of Germany ..... 3916010
Mar. 1, 1990 [DE] Fed. Rep. of Germany ..... 4006397

[51] Int. Cl.[5] ..... D01F 6/96

[52] U.S. Cl. ..... 264/143; 264/168; 264/210.7; 264/210.8; 264/211.15; 264/211.17; 264/235.6; 264/289.6; 264/346; 264/290.5

[58] Field of Search ..... 264/210.7, 210.8, 168, 264/211.15, 235.6, 346, 143, 289.6, 290.5, 211.17

[56] References Cited

U.S. PATENT DOCUMENTS

| | | | |
|---|---|---|---|
| 3,895,091 | 7/1975 | Short et al. | 264/210.8 |
| 3,898,204 | 8/1975 | Short et al. | 264/236 |
| 3,912,695 | 10/1975 | Short et al. | 264/210.8 |
| 4,098,776 | 7/1978 | Tieszen et al. | 528/481 |
| 4,454,189 | 6/1984 | Fukata | 264/210.8 |
| 4,645,825 | 2/1987 | Idel et al. | 264/210.7 |
| 4,839,129 | 6/1989 | Mizuno et al. | 264/211.12 |

FOREIGN PATENT DOCUMENTS

| | | |
|---|---|---|
| 0171021 | 7/1986 | European Pat. Off. . |
| 0214470 | 3/1987 | European Pat. Off. . |
| 0283520 | 9/1988 | European Pat. Off. . |
| 2714610 | 10/1978 | Fed. Rep. of Germany . |
| 3428984 | 2/1986 | Fed. Rep. of Germany . |
| 3526066 | 1/1987 | Fed. Rep. of Germany . |
| 0214471 | 3/1987 | Fed. Rep. of Germany . |
| 58-18409 | 2/1983 | Japan . |

*Primary Examiner*—Hubert C. Lorin
*Attorney, Agent, or Firm*—Sprung Horn Kramer & Woods

[57] ABSTRACT

Processes for the production of mono- and multifilaments and also staple fibers of multifilaments based on polyarylene sulfides by melt spinning, multistage stretching and setting. As a result of the treatment by blowing of air onto the stabilized spun filaments in the first stretching stages at temperatures ≦100° C., the chain molecules are oriented; the orientation and crystallinity required for high strengths is achieved by after-stretching at elevated temperature. The residence times in the first stage required for effective stretching can only be varied within relatively narrow limits in order subsequently to achieve the calculated orientations and effects. Overly long residence times at temperatures above 100° C. result in elongation of the material with no additional orientation and hence with an inadequate increase in strength.

17 Claims, 2 Drawing Sheets

FIG. I

FIG.2
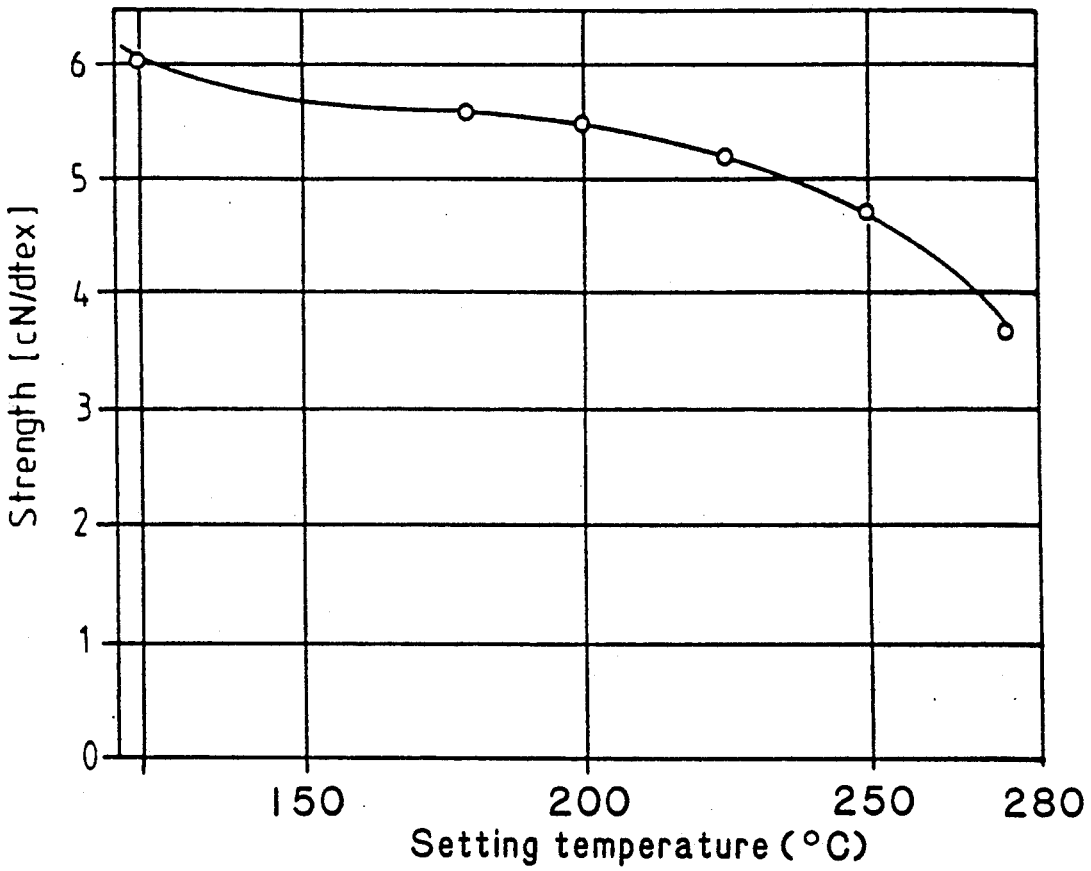
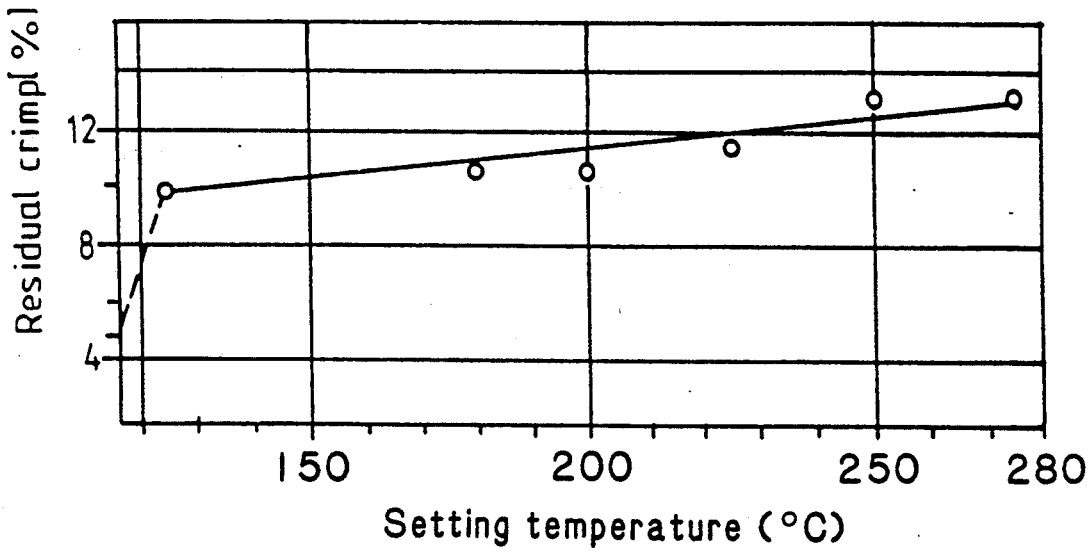
FIG.2A

PROCESSES FOR THE PRODUCTION OF MONO- AND MULTIFILAMENTS AND STAPLE FIBERS BASED ON POLYARYLENE SULFIDES

This invention relates to processes for the production of mono- and multifilaments and also staple fibers of multifilaments based on polyarylene sulfides, preferably substantially linear polyarylene sulfides and, more preferably, substantially linear poly-p-phenylene sulfide by melt spinning, multistage stretching and optionally crimping and setting.

As a result of the treatment by blowing of air onto the stabilized spun filaments in the first stretching stages at temperatures $\leqq 100°$ C. (preferably in stretching baths, more particularly in boiling water), the chain molecules are oriented; the orientation and crystallinity required for high strengths is achieved by afterstretching (in hot air) at elevated temperature. The residence times in the first stage required for effective stretching in accordance with the invention can only be varied within relatively narrow limits in order subsequently to achieve the calculated orientations and effects, particularly high strengths, crystallinities and densities. Overly long residence times at temperatures above 100° C. result in elongation of the material with no additional orientation and hence with an inadequate increase in strength To increase crystallinity and strength in the production of mono- and multifilaments, multistage stretching may be followed by a thermal aftertreatment; in the staple fiber process, the material is additionally crimped, set (in the absence of tension) and cut. Where an aerodynamic crimping nozzle is used, as is preferably the case, stretching has to be carried out in accordance with the invention in such a way that the the fibers are left with sufficiently high shrinkage which is important for crimping and subsequent processing. Crimping is improved by setting in the absence of tension. Relatively high-tensile fibers with sufficiently high residual crimping for subsequent processing are obtained.

Textile-denier fibers (up to about 20 dtex) having hitherto unknown strengths of $>6$ cN/dtex, preferably $>6.2$ cN/dtex and, more preferably, $>6.4$ cN/dtex are claimed.

Processes for the production of mono- and multifilaments of polyphenylene sulfide by melt extrusion and subsequent single-stage and multistage stretching are described for example, in U.S.-PSS No. 3,895,091, 3,898,204 and 3,912,695, in EP 283 520, in JP 115 123 and in JP 5 818 409. In these processes, the polyphenylene sulfide has to be partly cured before the extrusion stage (cf. EP-A 214 470 and 214 471). Literature describing the production of PPS fibers is cited in detail in DE-OS 3 526 066 (columns 1 and 2).

In addition, it is known from U.S.-PS No. 4,098,776 and from JP-PS 1 38 209 that the strength values obtainable by stretching can be increased by an additional thermal treatment. Suitable polyarylene sulfides are described in EP-A 171 021. The stretching process for PPS is described by P.L. Carr and I.M. Ward in Polymer (1987), 28, 2070–2076, although they were unable in their process to obtain the claimed highly oriented fibers with the strengths applicants are claiming.

It has now been found that the various process steps involved in stretching and aftertreatment require certain conditions to achieve the desired solidification of the material at the stretching stage in this selected range. By observing the residence time and temperature conditions, the multistage stretching according to the invention leads to highly oriented, highly crystalline and high-strength mono-and multifilaments and not to plastic, deformed filament structures of poor quality. Substantially linear polyarylene sulfides, particularly polyphenylene sulfides, are preferred in this regard, those of substantially linear structure being particularly preferred.

Processes for the production of crimped fibers of poly-p-phenylene sulfide are not known in the literature.

The problem addressed by the present invention was to coordinate the individual process steps carefully with one another to obtain good textile properties, particularly hitherto unknown strengths and orientations, in addition to sufficiently good and stable crimping for subsequent processing In the process according to the invention, the necessary residence times in the stretching stages, i.e. the type of stretching with corresponding distribution of the degrees of stretching and the stretching zone temperatures, were determined in accordance with the invention for the production of mono- and multifilaments and fibers of high crystallinity, orientation and strength.

Accordingly, the present invention relates to a process for the production of mono- and multifilaments and staple fibers based on polyarylene sulfides by melt spinning, stretching and optionally setting, characterized in that a) uncured granules of polyarylene sulfide, more particularly a substantially linear polyphenylene sulfide, having a melt viscosity of 30 to 300 Pa.s, as measured at 306° C. and at a shear rate of 1/1,000 s, are melt spun, b) hot air, preferably at 50° C. to 150° C., or another gas is blown onto the multifilaments beneath the nozzle during spinning or monofilaments of relatively high denier, corresponding to diameters of 0.2 to 2 mm, are cooled in a cooling bath (this is the preferred and more advantageous procedure for high-performance spinning — for example multifilament spinning), c) the mono- and multifilaments of the spun material are subjected after spinning to multistage stretching as follows:

1) in a first stretching stage avoiding plastic flow, i.e. elongation with no significant orientation, in a stretching ratio $\gamma_1$ of 2.5 to 5.0, preferably 3.0 to 5.0 and more preferably 3.5 to 4.0, more especially in water baths with temperatures above 80° C. and preferably from 95° C. to 100° C., more preferably in boiling water, with residence times at that temperature of 0.1 to 1.0 second and preferably 0.2 to 0.8 second, 2) in a second stretching stage, the mono- and/or multifilaments are afterstretched, preferably in a stretching bath at 80° C. to 100° C., more especially in boiling water, with residence times at that temperature of 0.1 to 5 seconds, preferably 0.1 to 1.0 second and more preferably 0.1 to 0.5 second, so that the overall stretching ratio $\gamma_{1,2}=\gamma_1.\gamma_2=3.5$ to 7 and the material is thus partly crystallized and oriented so that 3) in a third stretching stage it can be afterstretched either continuously or discontinuously, preferably continuously, at temperatures of 150° C. to 260° C. and more particularly at temperatures of 180° C. to 240° C. in a hot air tunnel with a stretching ratio $\gamma_3$ in this stage of more than 1.05, for example from 1.2 to 1.6 and more especially from 1.4 to 1.6, with residence times at these temperatures of longer than 0.1 second and preferably from 0.3 to 10 seconds to an overall stretching ratio $\gamma_{1,2,3}$, of 3.7 to 11.2 and d) the mono- and multifilaments, optionally after the multistage stretching, are heat-set under tension or in the absence of tension (preferably under tension).

The process for the production of staple fibers is characterized in that the multifilament a) after spinning and stretching by the method described above is stretched in such a way that it is left with a shrinkage of 2 to 70% and preferably 4 to 15% and b) is mechanically or aerodynamically or hydrodynamically crimped, preferably aerodynamically or hydrodynamically crimped, and c) is set in the absence of tension for between 30 and 600 seconds at a temperature of 150° C. to 250° C. and preferably at a temperature of 180° C. to 220° C.

The present invention also relates to highly oriented polyarylene sulfide fibers, preferably polyphenylene sulfide fibers of substantially linear structure, having strengths of >6.0 cN/dtex, preferably ≧6.4 cN/dtex and more preferably ≧7.0 cN/dtex. In general, they also have high double refraction values of >0.46, densities of ≧1.37 and crystallinities of 40%.

BRIEF DESCRIPTION OF THE DRAWINGS

FIGS. 2 and 2A show the dependence of fiber strength and the residual crimping values on the setting temperature.

DESCRIPTION OF THE PROCEDURE

Figure 1:
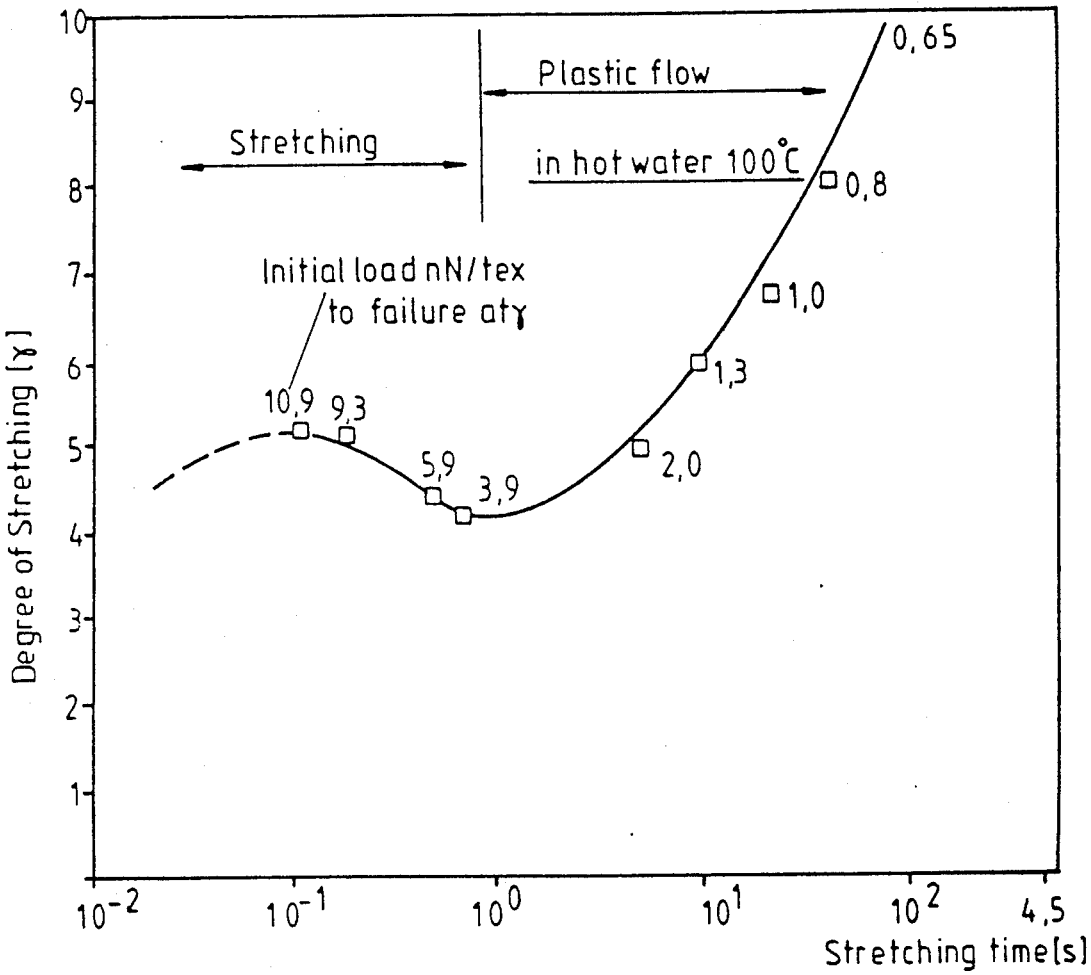
FIG. 1 shows the relationship between degree of stretching, stretching time and filament tensile strength in a creep experiment.

The predried uncured granules of polyarylene sulfides, preferably substantially linear poly-p-phenylene sulfide (i.e. without using trifunctional starting compound), dried for 4 hours at 140° C., are melted in an extruder at 330° C. and the resulting melt is dosed by a spinning pump and extruded through a single-bore or multiple-bore spinneret. To prevent the polyphenylene sulfides from being damaged by oxidation and to prevent gas bubbles from being taken in, a vacuum is applied to the extruder by way of a storage container. Monofilaments are cooled in a water bath, multifilaments have hot air or another gas blown onto them beneath the spinneret to promote spinnability and subsequent stretching behavior.

The takeoff rates are between 10 and 5,000 m/minute and preferably between 20 and 300 m/minute, depending on the process (thin filaments for melt spinning in air or relatively thick filaments for spinning into water). The slower speed applies to spinning into a water bath.

A multistage stretching treatment is then applied.

In creep tests, it was found that when spun material of the type in question is stretched for longer than one second, for example in boiling water, the filament is merely elongated with no additional orientation. This can be illustrated with the aid of FIG. 1 which shows the relationship between degree of stretching, stretching time and filament tensile strength (initial load) in a creep experiment carried out in hot water with spun material according to Example 2. The high elongation capacity of the material of more than 1:10, even under the effect of minimal loads, is particularly surprising. However, elongation as high as this takes considerable time. Radiographic measurements show no significant increase in the orientation of the chain molecules (i.e. only plastic flow). Stretchability shows a maximum at a residence time of approximately 0.1 second. Heavier loads on the filaments increase the stretching rate, latent weak spots growing relatively quickly and becoming critical prematurely, which can compromise the safety of corresponding processes.

Surprisingly, however, a distinct orientation increasing with decreasing stretching time was observed by radiography in the stretching time range according to the invention (0.1–10 seconds, preferably 0.1–1 second). Accordingly, the shorter stretching times are generally preferred in the process according to the invention. Polyphenylene of relatively high molecular weight shows the radiographic orientation for longer stretching times than low molecular weight PPS. Accordingly, the longer stretching times (in the first stretching stage) are therefore tolerated by the relatively high molecular weight polyphenylene sulfides, less so by the polyphenylene sulfides of lower molecular weight.

On an industrial scale, therefore, the material is, initially, not fully stretched in a first series of stretching stages carried out at relatively low temperature and another stretching stage is added. Accordingly, stretching may be carried out at generally reduced speeds so that the material is treated sufficiently gently during stretching.

The two-stage stretching treatment (C1 and C2) at low temperatures (100° C. max.) results in oriented mono- or multifilaments of relatively low, but distinct crystallinity. However, the stretching treatment according to the invention at relatively low temperature (by virtue of the tension-induced degree of crystallinity) gives the material the thermal stability which enables it to be subsequently treated in a following stetching stage carried out at relatively high temperature.

The afterstretching c3) is carried out in hot gaseous media (hot air) at temperatures above 150° C. and preferably in the range from 180° C. to 240° C., a higher degree of crystallinity being obtained than after stretching at the relatively low temperatures (stages c1) and c2)). It has been found that, during stretching in accordance with the invention, the filament temperature after stage 3) passes through the temperature range in which the crystallization half life period has a minimum so that crytallization takes place particularly quickly and effectively. After-stretching by hot contact stretching (for example on metal plates) is generally less effective and also results in uneven treatment (particularly in the case of relatively thick filaments).

The multistage stretching may be carried out continuously or discontinuously with an interruption after the two-stage stretching at relatively low temperature, but is preferably carried out continuously.

On account of the limited dimensions of the apparatus, short residence times (for example 0.4 to 0.7 seconds) in the high-temperature stretching zone are obtained where stretching is carried out continuously.

the strength of the material may be further improved by setting with or without shrinkage, preferably by setting under tension.

In discontinuous stretching, the longer residence time in the high-temperature stretching stage enables setting to be combined with that stretching stage.

For monofilaments and multifilaments, the process is complete after stretching or setting. In the staple fiber process, the multifilaments are crimped after stretching in hot air (several spun filaments optionally combined into a tow), set in the absence of tension and cut. The material may be crimped by a mechanical process, but is preferably crimped by a hydrodynamic or aerodynamic process (which is the preferred process because it is kinder to the material). In this process, crimping is carried out by means of a device consisting of a tunnel for the transport of filaments through a surrounding stream of gas or steam, followed concentrically by a bar cage serving as stuffer box (for example DE 27 14 610 A 1).

An excessive degree of crystallinity and hence inadequate shrinkage of the material offers excessive resistance to subsequent deformation of the filaments in this crimping process. Since the shrinkage behavior can be influenced by the preceding stretching stages and since high shrinkage leads to inadequate fiber strength, stretching has to be carefully coordinated with the crimping process.

It has been found to be favorable in this regard to stretch multifilaments in such a way that they are left with a shrinkage of at least 2%. Sufficiently high crimping can be imparted to this material by a crimping nozzle operated with hot air or saturated steam at a temperature of 100° C. to 240° C. and preferably at a temperature of 140° C. to 220° C. Since crimping increases with increasing shrinkage values of the stretched fibers after shrinkage has been initiated, whereas tensile strength undergoes a distinct reduction, shrinkage should be set at no more than 70% and preferably at no more than 15%. Crimping can be further improved by subsequent setting in the absence of tension for 30 to 600 seconds at a temperature of 150° C. to 250° C.

FIG. 2 shows the dependence of fiber strength and the residual crimping values on the setting temperature. The residual crimping values were determined in accordance with DIN 53 840 on the basis of the following equation $$RC = \frac{l_2 - l_3}{l_2}$$

where $l_2$ is the decrimped length for a tension of 10 mN/dtex and $l_3$ is the crimped length for a tension of 0.1 mN/dtex after application of the load of 10 mN/dtex.

The residual crimping values increase continuously with the setting temperature and, in the illustrated example, may be increased from 4% to more than 12% for a setting time of 300 seconds. Although the residual crimping values continue to increase at very high setting temperatures above 220° C., there is an excessive reduction in the fiber strengths.

The crimped tow produced in this way may readily be cut to staple fibers of variable length and further processed.

Substantially linear PPS compounds suitable for use in accordance with the invention may be produced, for example, by the processes according to DE-A-3 428 984/5/6 which are based on polycondensation using highly polar solvents.

The fibers obtained by the process according to the invention may be used with advantage in the industrial sector, for example in the removal of the dust from hot gases, in dry and wet filtration up to and including dry felts for papermaking machines, more particularly in the hot passage, friction linings, seals and packaging, sewing thread and electrical applications in other corresponding industrial fields. In the textile field, heatproof apparel can be manufactured from polyarylene sulfide fibers, more particularly polyphenylene sulfide fibers.

EXAMPLES

Example 1 (monofilament)

The granules — dried for 4 hours at 140° C. — of an uncured, substantially linear poly-p-phenylene sulfide (produced by a process carried out in highly polar solvents) having a melt viscosity of 90 Pa.s (as measured at 306° C. and at a shear rate $\gamma$ of 1/1,000 s) are melted in an extruder at approximately 310° C., extruded through a singlebore spinneret with a bore diameter of 0.3 to 1.6 mm and quenched in a water bath. The takeoff rate is 100 m/minute. The filament is then continuously stretched in two stages in boiling water in tanks each 1.5 m in length, the degrees of stretching $\gamma_1$ and $\gamma_2$ in the individual stages being 3.5 and 1.3, respectively, and is then afterstretched by 30% in a 4 m long hot air tunnel heated to 200° C. The following textile data are obtained:

| | |
|---|---|
| Denier | 980 dtex |
| Strength (after spinning and stretching plus setting in accordance with the invention) | 5.0 cN/dtex |
| Elongation at break | 20% |
| Knot strength | 75% |
| Modulus | 60 cN/dtex |
| Filament uniformity (Uster) | 3% |

Example 2 (multifilament/textile denier)

The dried granules of Example 1 are melted in an extruder at approximately 310° C. and extruded through a 100-bore spinneret. Air heated to 80° C. is blown onto the multifilaments which are taken off at a rate of 100 m/minute. They are continuously stretched in two stages in boiling water in tanks each 1.5 m in length, the degrees of stretching $\gamma_1$ and $\gamma_2$ in the individual stages being 3.5 and 1.3, respectively, and are then afterstretched by 25% in a 4 m long hot air tunnel heated to 225° C. Before being wound up, the multifilaments are set under tension for 30 seconds at 200° C. The following data are obtained:

| | |
|---|---|
| Denier | 3.3 dtex |
| Strength | 6.2 cN/dtex |
| Elongation at break | 13% |
| Shrinkage on boiling | 4% |
| Heat shrinkage at 200° C. | 7% |

Further experiments have shown that even higher filament strengths can be obtained with PPS of even higher molecular weight (molecular weight >100 Pa.s, as measured under the conditions described above).

Example 3 (multifilament)

Dried granules of substantially linear poly-p-phenylene sulfide having a melt viscosity of 120 Pa.s are melted in an extruder at approximately 315° C. and extruded through a 400-bore spinneret. Air heated to 80° C. is blown onto the multifilaments which are taken off at a rate of 100 m/minute. They are continuously stretched in two stages in boiling water in tanks each 1.5 m in length, the degrees of stretching $\gamma_1$ and $\gamma_1$ in the individual stages being 3.5 and 1.3, respectively, and are then afterstretched by 15% in a 4 m long hot air tunnel heated to 225° C. The multifilament tow is delivered to a crimping nozzle, crimped at 150° C. and, before cutting, is set in the absence of tension for 240 seconds at a temperature of 190° C. The following individual fiber values are obtained:

| | |
|---|---|
| Denier | 3.4 dtex |
| Strength | 5.5 cN/dtex |
| Elongation at break | 20% |
| Shrinkage on boiling | 0% |
| Heat shrinkage at 200° C. | 4% |
| Residual crimp | 10% |

The setting step stabilizes the crimped filaments against changes in length under the effect of heat.

The wide-angle radiographs from various stages of PPS fiber production show quite generally that the spun material is amorphous and non-oriented after spinning. Diffraction tests on stretched and set PPS according to the invention show that this material is highly oriented and highly crystalline.

X-ray small-angle scattering shows a discrete reflex which may be assigned to a long period of 100 to 150 Å. These and other measurements suggest that crystalline PPS is present in a two-phase structure with disproportionated amorphous and crystalline regions. Crystallinity values of more than 40% at densities of 1.37 g/cm$^3$ were observed for the crystallinity of conditioned, fully set PPS fibers obtained by the process according to the invention (the density of the amophous material is approximately 1.32 g/cm$^3$, the calculated value for 100% crystalline material is approximately 1.43). Density is measured by buoyancy in water.

The resistance of the fibers to almost all organic substances is excellent and there is to date no known solvent which dissolves PPS below 200° C.

Example 4 (multifilaments)

Dried granules having a melt viscosity of 140 Pa.s (as measured at 306° C. and at a shear rate $\gamma$ of 1,000 s$^{-1}$) are melted in an extruder at 315° C. and the resulting melt extruded through a 24-bore spinneret. The filaments are taken off at 60 m/min., continuously stretched in two stages in boiling water in tanks each 1.5 m in length, the degrees of stretching $\gamma_1$ and $\gamma_2$ in the individual stages being 3.0 and 1.5, respectively, and then wound up.

The filaments are afterstretched by 19% in a 4 m long hot air tunnel heated to 230° C. which they enter at a rate of 30 m/minute.

The following textile data are obtained:

| | |
|---|---|
| Denier | 11.4 dtex |
| Strength | 7.6 cN/dtex |
| Elongation at break | 16% |
| Density | >1.375 g/cm$^3$ |

The optical double refraction of the highly oriented fibers measured 0.468. This is particularly high value and appears to apply generally to the high-strength fibers produced in accordance with the invention (>0.460). The double refraction is measured with an Elvinghaus rotary compensator with compensation plates of calcite.

We claim:

1. A process for the production of monofilaments and multifilaments based on linear polyarylene sulfide by melt spinning, stretching and setting, wherein a) uncured granules of polyarylene sulfide having a melt viscosity of 30 to 300 Pa,s, as measured at 306° C. and at a shear rate $\gamma$ of 1/1,000 sec, are melt spun through a nozzle to form a monofilament or a multifilament, b) hot air at 50° C. to 150° C., or another inert gas, is blown onto the filaments beneath the nozzle during melt spinning c) the mono- and multifilaments of the spun material are subjected after spinning to multistage stretching as follows:

1) a first stretching stage avoiding elongation with no significant orientation, in a stretching ratio $\gamma_1$ of 2.5 to 5.0, in a water bath with temperatures about 80° C. with residence times at that temperature of 0.1 to 5 seconds, 2) in a second stretching stage, the mono- or multifilaments are afterstretched, in a stretching bath at 80° C. to 100° C. with residence times at that temperature of 0.1 to 10 seconds so that the overall stretching ratio $\gamma_{1,2}=\gamma_1 \cdot \gamma_2=3.5$ to 7 and the material is thus partly crystallized and oriented so that 3) in a third stretching stage it can be afterstretched either continuously or discontinuously at temperatures of 150° C. to 260° C. in hot gases with a stretching ratio $\gamma_3$ in this stage of more than 1.05 with residence times at these temperatures of longer than 0.1 second to an overall stretching ratio $\gamma_{1,2,3}$, of 3.7 to 11.2 and d) the mono- and multifilaments, after the multistage stretching, are heatset under tension or in the absence of tension.

2. A process as claimed in claim 1, wherein substantially linear polyphenylene sulfide produced by condensation in highly polar solvents with no after-curing of the polyphenylene sulfide is used.

3. A process for the production of staple fibers from multifilaments produced in accordance with claim 1, wherein the linear polyarylene sulfide is polyphenylene sulfide and the multifilament a) after spinning and stretching in accordance with claim 1, is stretched in such a way that is is left with a shrinkage of 2 to 70% and b) is mechanically or aerodynamically or hydrodynamically crimped, c) is set in the absence of tension for between 30 and 600 seconds at a temperature of 150° C. to 250° C., and d) staple fibers are cut from the multifilaments.

4. A process according to claim 1 wherein the filaments are monofilaments of relatively high denier corresponding to diameters of 0.2 2 mm and step b) is carried out by cooling directly in a cooling bath, rather than by blowing with hot air.

5. A process according to claim 1, wherein in the first stretching stage c)1) the stretching ratio is 3.0 to 5.0.

6. A process according to claim 1, wherein in the first stretching stage c)1) the stretching ratio is 3.5 to 4.0.

7. A process according to claim 1, wherein in the first stretching stage c)1) the water bath temperature is from about 95° C. to 100° C.

8. A process according to claim 1, wherein in the first stretching stage c)1) the residence time is 0.1 to 1.0 second.

9. A process according to claim 1, wherein in the first stretching stage c)1) the residence time is 0.2 to 0.8 second.

10. A process according to claim 1, wherein in the second stretching stage c)2) the residence time is 0.1 to 0.8 second.

11. A process according to claim 1, wherein in the third stretching stage c)3) the temperature is from about 180° C. to 240° C.

12. A process according to claim 1, wherein in the third stretching stage c)3) the stretching takes place in a hot air tunnel.

13. A process according to claim 1, wherein in the third stretching stage c)3) the stretching ratio is from 1.2 to 1.6.

14. A process according to claim 1, wherein in the third stretching stage c)3) the stretching ratio is from 1.4 to 1.6.

15. A process according to claim 1, wherein in the third stretching step the residence time is from 0.3 to 10 seconds.

16. A process according to claim 3, wherein the stretching which takes place in step a) is carried out in such a way that the filament is left with a shrinkage of 4 to 15%.

17. A process according to claim 3, wherein the setting which takes place in step c) is carried out at a temperature of 180° C. 220° C.

* * * * *

UNITED STATES PATENT AND TRADEMARK OFFICE

CERTIFICATE OF CORRECTION

PATENT NO. : 5,024,797

DATED : June 18, 1991

INVENTOR(S) : Anderheggen et al.

It is certified that error appears in the above-identified patent and that said Letters Patent is hereby corrected as shown below:

Col. 8, line 46 After " claim 1 " insert -- (steps a) to c )) --

Col. 8, line 56 After " 0.2 " insert -- to --

Signed and Sealed this

Fourth Day of May, 1993

*Attest:*

*Attesting Officer*

Michael K. Kirk

MICHAEL K. KIRK

*Acting Commissioner of Patents and Trademarks*